US011091345B2

(12) United States Patent
Sawada

(10) Patent No.: US 11,091,345 B2
(45) Date of Patent: Aug. 17, 2021

(54) LOADING APPARATUS AND PRINTER

(71) Applicant: SEIKO EPSON CORPORATION, Tokyo (JP)

(72) Inventor: Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/898,504

(22) Filed: Jun. 11, 2020

(65) Prior Publication Data

US 2020/0391972 A1 Dec. 17, 2020

(30) Foreign Application Priority Data

Jun. 14, 2019 (JP) ..... JP2019-110901

(51) Int. Cl.

| | |
|---|---|
| ***B65H 31/10*** | (2006.01) |
| ***B65H 31/26*** | (2006.01) |
| ***B65H 29/12*** | (2006.01) |
| ***B41J 13/10*** | (2006.01) |
| ***B41J 13/00*** | (2006.01) |

(52) U.S. Cl.

CPC ..... *B65H 31/10* (2013.01); *B41J 13/0036* (2013.01); *B41J 13/106* (2013.01); *B65H 29/125* (2013.01); *B65H 31/26* (2013.01); *B65H 2301/422* (2013.01); *B65H 2301/515* (2013.01); *B65H 2403/725* (2013.01); *B65H 2405/1118* (2013.01); *B65H 2405/11152* (2013.01); *B65H 2405/211* (2013.01)

(58) Field of Classification Search

CPC ..... B65H 2405/35; B65H 2405/11152; B65H 2405/1118; B65H 31/26

See application file for complete search history.

(56) References Cited

U.S. PATENT DOCUMENTS

| | | | | |
|---|---|---|---|---|
| 4,364,553 | A * | 12/1982 | Wilson | B65H 31/10 271/207 |
| 2008/0122164 | A1* | 5/2008 | Sparer | B65H 29/52 271/207 |
| 2008/0308986 | A1* | 12/2008 | Dobashi | B65H 29/6645 270/12 |
| 2008/0308998 | A1* | 12/2008 | Dobashi | B65H 43/06 271/18 |
| 2011/0062645 | A1* | 3/2011 | Yokochi | B65H 29/34 270/45 |

FOREIGN PATENT DOCUMENTS

JP 2005-15189 A 1/2005

* cited by examiner

*Primary Examiner* — Howard J Sanders
(74) *Attorney, Agent, or Firm* — Workman Nydegger

(57) ABSTRACT

A loading apparatus including a support surface facing forward and inclined vertically downward from a paper exit of a printer body and configured to come into contact with a first surface of a printed material, the first surface forming a vertically downward surface in the paper exit, a braking member provided near the paper exit and configured to come into contact with the first surface and to hold a part, whixh contacts therewith, of the printed material, and a stopper configured to come into contact with a downstream leading end of the printed material at a paper ejection direction in which the printed material is ejected. The stopper is configured to be located at a first position and a second position on the support surface, in which a distance between the second position and the paper exit is greater than a distance between the first position and the paper exit.

8 Claims, 9 Drawing Sheets

LOADING APPARATUS AND PRINTER

The present application is based on, and claims priority from JP Application Serial Number 2019-110901, filed Jun. 14, 2019, the disclosure of which is hereby incorporated by reference herein in its entirety.

BACKGROUND

1. Technical Field

The present disclosure relates to a loading apparatus and a printer.

2. Related Art

In the related art, a printing apparatus is known, as described in JP 2005-15189 A, which includes a printing means for performing printing on a paper, and a stacker unit configured to eject the printed paper through an opening portion and to place the ejected paper on a placement surface.

However, when the printed paper curls convexly with respect to the placement surface in the stacker unit of the apparatus, the leading end portion in the transport direction of the paper that is subsequently ejected may not override the upstream end of the paper placed in a curled manner. Thus, the paper that is subsequently ejected may be inserted between the paper placed in a curled manner and the placement surface. As a result, an issue arises in that the printing order of the printing means does not coincides with the loading order by which loading is performed on the stacker unit.

SUMMARY

A loading apparatus supporting a printed material ejected through a paper exit of a printer body, the loading apparatus including a support surface facing forward and inclined vertically downward from the paper exit and moreover configured to come into contact with a first surface of the printed material, the first surface being a vertically downward surface at the paper exit, a braking member provided near the paper exit and configured into come in contact with the first surface and to hold a part, which contacts therewith, of the printed material, and a stopper configured to come into contact with a downstream leading end of the printed material in a paper ejection direction in which the printed material is ejected, wherein the stopper is located at a first position and a second position on the support surface, and a distance between the second position and the paper exit is greater than a distance between the first position and the paper exit.

A printer includes a paper exit through which a printed material is ejected, a support surface facing forward and inclined vertically downward from the paper exit and moreover configured to come into contact with a first surface of the printed material, the first surface forming a vertically downward surface at the paper exit, a braking member provided near the paper exit and configured to come into contact with the first surface and to hold a part, which contacts therewith, of the printed material, and a stopper configured to come into contact with a downstream leading end of the printed material in a paper ejection direction in which the printed material is ejected, in which the stopper is configured to be located at a first position and a second position on the support surface, and a distance between the second position and the paper exit is greater than a distance between the first position and the paper exit.

DESCRIPTION OF EXEMPLARY EMBODIMENTS

1. Embodiment 1

First, a configuration of a printer 11 will be described.

Figure 1:
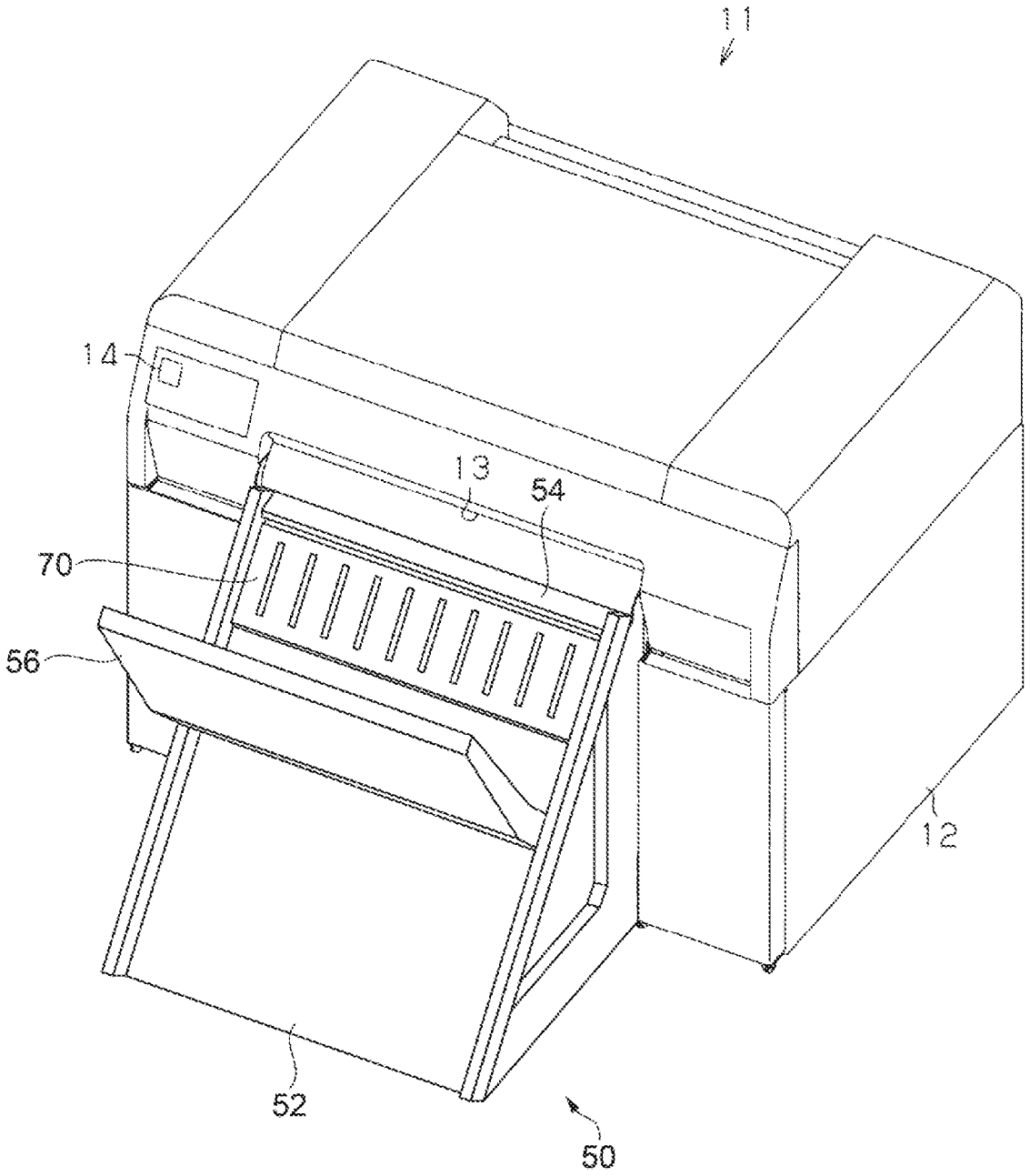
FIG. 1 is a perspective view illustrating a configuration of a printer.
Figure 2:
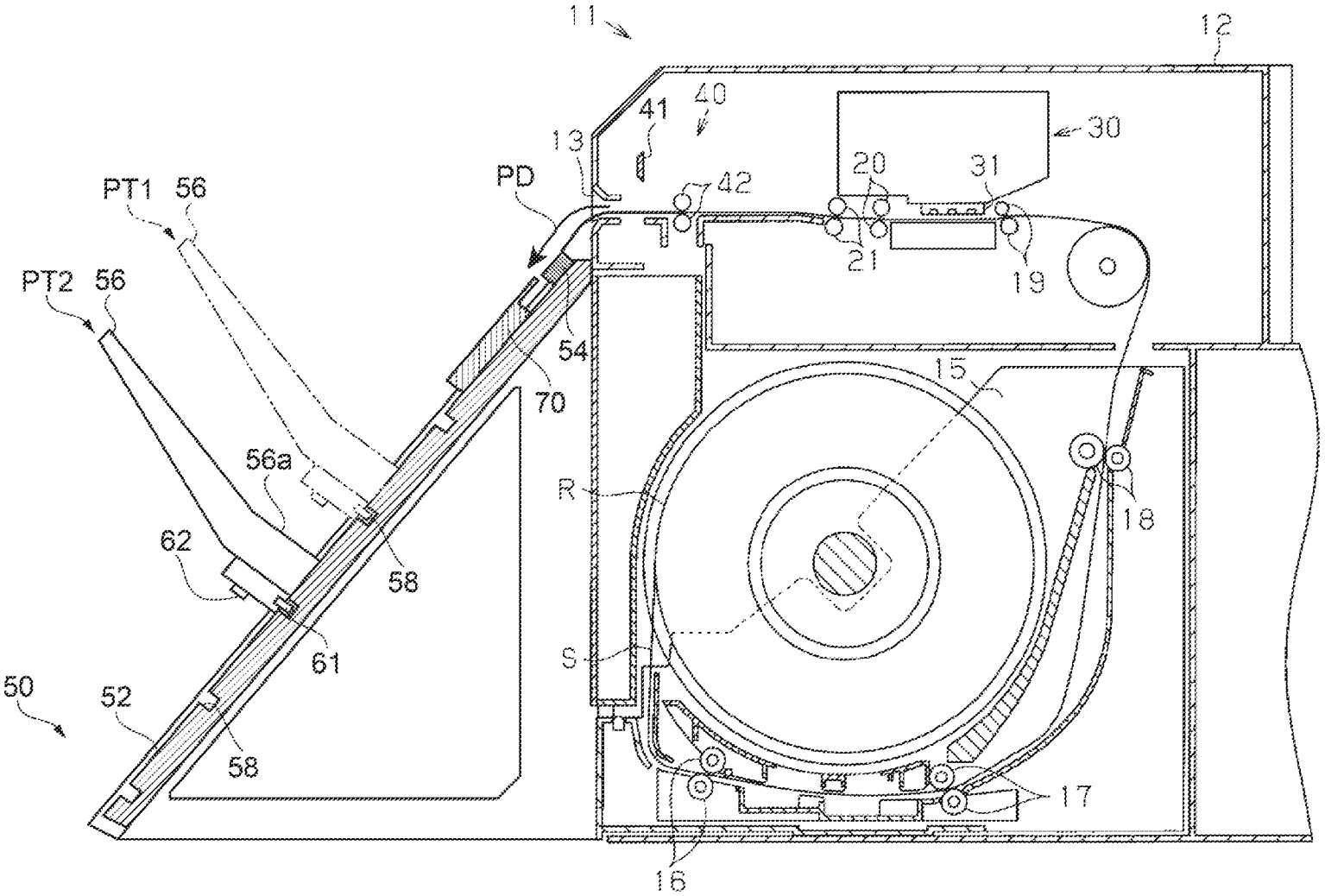
FIG. 2 is a cross-sectional side view illustrating a configuration of a printer.

FIG. 1 is a perspective view illustrating a configuration of the printer 11, and FIG. 2 is a cross-sectional side view illustrating the configuration of the printer 11. The printer 11 is, for example, an ink jet type printer configured to perform recording by injecting ink to a medium such as paper.

As illustrated in FIGS. 1 and 2, the printer 11 includes a housing unit 12 as a printer body forming an exterior portion of the printer 11, and a loading apparatus 50 configured to support a cut paper CP (not illustrated) as a printed material on which recording has been performed. A paper exit 13 having a slit-shape configured to eject a sheet S on which recording has been performed is provided, at a position above the loading apparatus 50, on the front face of the housing unit 12. An operation unit 14 for operating the printer 11 is provided on the front face of the housing unit 12.

The housing unit 12 is provided with, inside the housing unit 12, a roll body R around which the sheet S is wound, and a medium holding unit 15 configured to rotatably hold the roll body R around a rotation axis coincident with the width direction of the housing unit 12. The housing unit 12 is also provided with, inside the housing unit 12, transport rollers 16, 17, 18, 19, 20, and 21 configured to provide a transport force to the sheet S when transporting the sheet S that is unwound from the roll body R toward downstream in a transport direction in which the paper exit 13 is located.

There is also provided, above the space that houses the medium holding unit 15, a recording unit 30 configured to perform recording on the sheet S that is unwound from the roll body R, and a cutting unit 40 configured to cut the sheet S on which recording has been performed by the recording unit 30 to generate the cut paper CP. The recording unit 30 includes a liquid injection head 31 configured to inject ink to the sheet S. Further, the cutting unit 40 includes a cutter 41 configured to cut the sheet S and a clamping roller pair 42 configured to clamp the sheet S when the cutter 41 cuts the sheet S. In addition, the clamping roller pair 42 clamps the sheet S from the upper and lower directions upstream of the cutter 41 in the transport direction. This allows the cutting to be performed in a state where the sheet S is being restricted from moving, that is, in a state where the sheet S is being fixed.

The cut paper CP having been cut by the cutter 41 is ejected through the paper exit 13 toward the loading apparatus 50. The cut paper CP having been ejected is supported by the loading apparatus 50.

Figure 3:
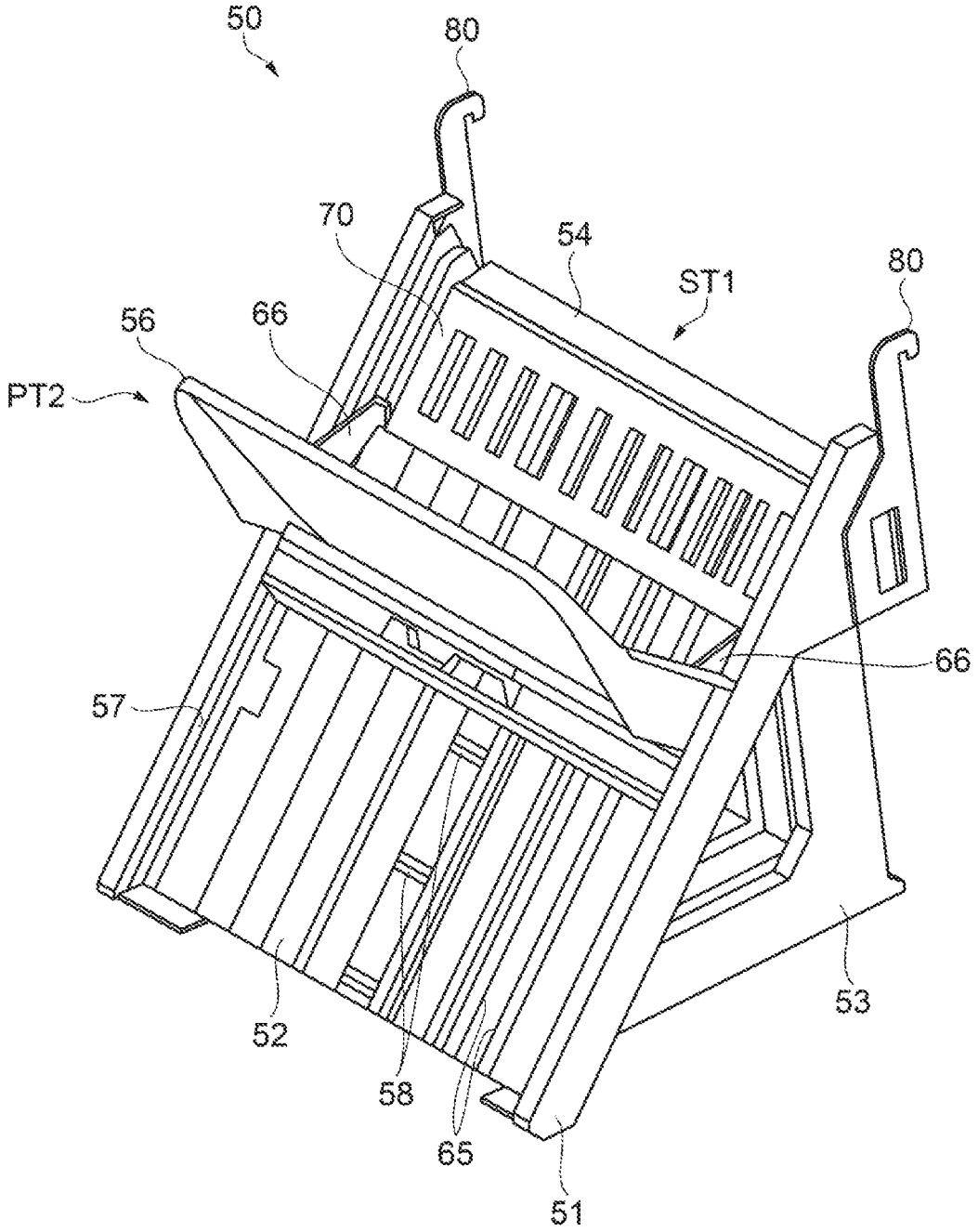
FIG. 3 is a perspective view illustrating a configuration of a loading apparatus.
Figure 4:
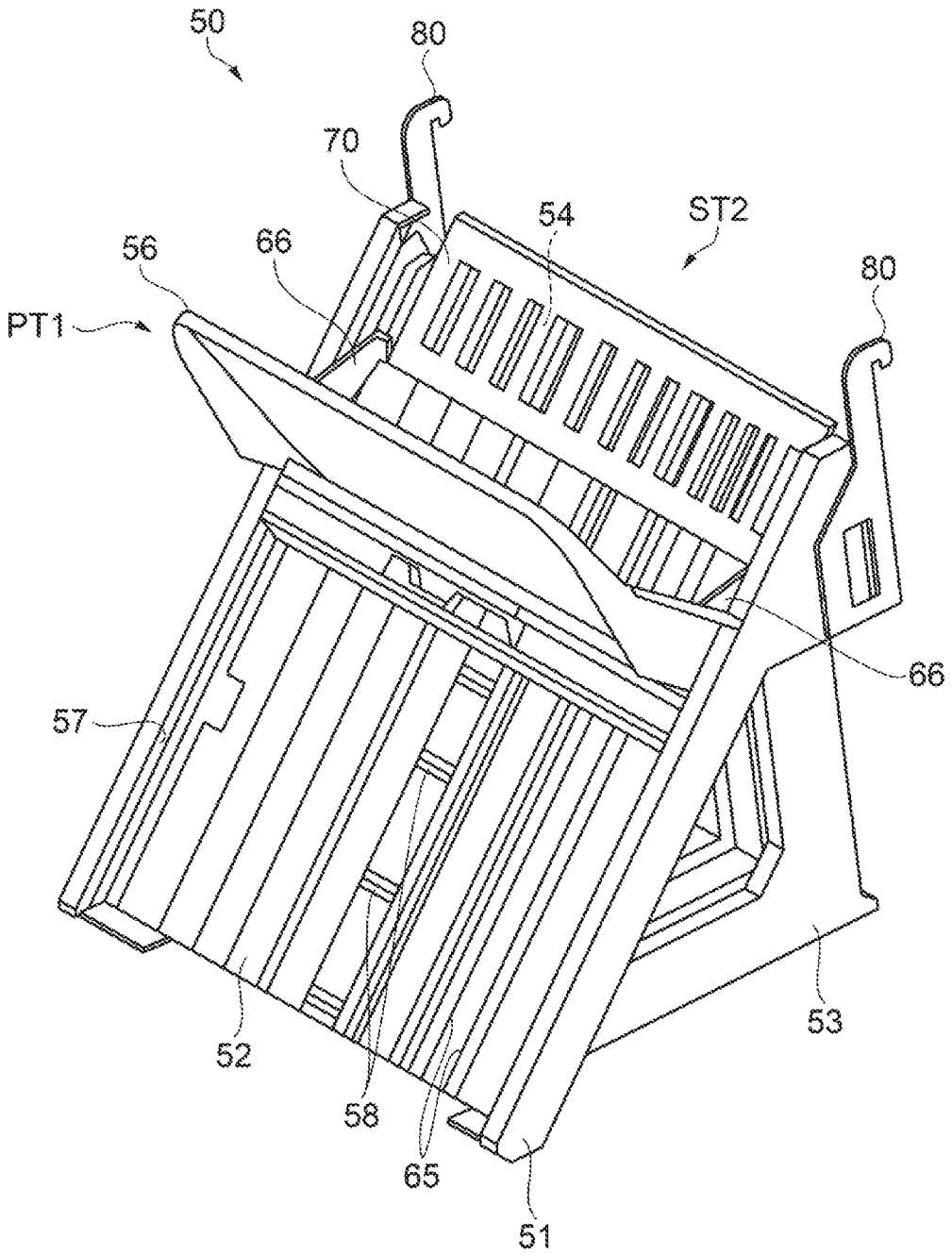
FIG. 4 is a perspective view illustrating a configuration of a loading apparatus.

Next, a configuration of the loading apparatus 50 will be described. FIGS. 3 and 4 are perspective views illustrating a configuration of the loading apparatus 50. The loading apparatus 50 includes a support surface 52 configured to come in contact with a first surface P1 of the cut paper CP, a braking member 54 provided near the paper exit 13, and configured to come in contact with the first surface P1 and to hold the contacting part of the cut paper CP, and a stopper 56 configured to come in contact with the downstream leading end of the cut paper CP in a paper ejection direction PD in which the cut paper CP is ejected. The support surface 52 is inclined vertically downward toward the front, which is a direction in which the support surface 52 is separated from the paper exit 13. Further, the first surface P1 with which the support surface 52 can come in contact is a vertically downward surface at a timing when the cut paper CP is ejected through the paper exit 13. In other words, the first surface P1 with which the support surface 52 can come in contact is a vertically lower surface in the paper exit 13.

The loading apparatus 50 of the embodiment is configured to be attachable to/detachable from the housing unit 12. The loading apparatus 50 includes a hook portion 80 having a thin plate-shape for allowing the user to attach the loading apparatus 50 to the housing unit 12. The housing unit 12 is provided with an insertion portion into which the hook portion 80 can be inserted. The insertion portion is provided with a receiving portion that engages with the hook portion 80. The user can insert the hook portion 80 into the insertion portion to cause the hook portion 80 to engage with the receiving portion, to thus integrate the loading apparatus 50 with the housing unit 12.

The support surface 52 is provided on a support plate 51 having a rectangular shape. The support surface 52 has a width direction dimension equivalent to the width dimension of the paper exit 13. The upper end portion of the support surface 52 is located below the paper exit 13, and the lower end portion of the support surface 52 is located at approximately the same position as the lower end portion of the housing unit 12. The support plate 51 is supported by a base body 53. The support plate 51 is formed of a plastic material. Examples of the plastic material that forms the support plate 51 include an olefin resin such as polyethylene, polypropylene, and the like, or a polyester resin represented by polyethylene terephthalate (PET).

Note that the support surface 52 comes in contact with the first surface P1 of the cut paper CP, however, in a strict sense, the support surface 52 is considered to be in a state of being in contact with the first surface P1 even in a state where the end of the cut paper CP is being in contact with the support surface 52 when the first surface P1 of the cut paper CP is in a state of facing the side of the support surface 52.

The support surface 52 is formed with a rib 65 along the paper ejection direction PD. The rib 65 is a thin-line shaped convex portion extending from the upper end portion to the lower end portion of the support surface 52. A plurality of the ribs 65 are provided on the support surface 52. This makes it possible to reduce the contact area between the cut paper CP and the support surface 52, allowing the cut paper CP to be transported smoothly.

The braking member 54, which is the upper end portion of the support surface 52, is disposed below the paper exit 13. As described later, the braking member 54 of the embodiment comes in contact with the cut paper CP to minimize the curl of the cut paper CP. Accordingly, in the embodiment, the braking member 54 is provided on the upper end portion of the support surface 52, however, the braking member 54 may be provided, without being limited to this, at a position at which the curl of the cut paper CP can be minimized, that is, near the paper exit 13.

The braking member 54 forms a band shape along the width direction of the support surface 52. The braking member 54 forms an upwardly convex shape with respect to the support surface 52. The braking member 54 is formed of a member having a higher friction coefficient relative to the first surface P1 of the cut paper CP than the support surface 52. The braking member 54 is formed of, for example, polyurethane or a rubber material.

Note that the braking member 54 comes in contact with the first surface P1 of the cut paper CP, however, in a strict sense, the support surface 52 is considered to be in a state of being in contact with the first surface P1 even in a state where the end of the cut paper CP is being in contact with the support surface 52 when the first surface P1 of the cut paper CP is in a state of facing the side of the support surface 52.

The stopper 56 is a plate member disposed approximately perpendicular to the support surface 52. The stopper 56 is provided with a restricting surface **56*a* configured to come in contact with the downstream leading end of the cut paper CP to restrict the cut paper CP from moving downstream. The restricting surface 56*a* of the stopper 56 of the embodiment has the width dimension approximately equal to the width dimension of the support surface 52. The stopper 56 prevents the cut paper CP ejected through the paper exit 13 from moving downward and falling, which allows the loading apparatus 50** to hold the plurality of the cut papers CP on which recording has been performed.

The stopper 56 can be located at different positions on the support surface 52. In the embodiment, as illustrated in FIG. 4, the stopper 56 can be located at the first position PT1 on the support surface 52, and can be located at a second position PT2, which is larger in distance from the paper exit 13 than the first position PT1, as illustrated in FIG. 3. That is, the position of the stopper 56 can be appropriately changed depending on the size of the cut paper CP on which recording is to be performed. For example, when the user causes a cutting paper CP1 having a business card size (91 mm×55 mm) to be ejected, the user causes the stopper 56 to be located at the first position PT1, while when the user causes the cut paper CP2 having an L-size (127 mm×89 mm) that is larger in size than the cut paper CP1 to be ejected, the user causes the stopper 56 to be located at the second position PT2.

The stopper 56 of the embodiment is configured to be slidable on the support surface 52. Specifically, there are provided guide grooves 57 at both end parts in the width direction of the support surface 52 in the support plate 51. The stopper 56 is provided with a convex portion that is movably fitted into the guide groove 57. This allows the stopper 56 to easily move along the guide grooves 57 to the first position PT1 and the second position PT2.

Further, the support surface 52 is provided with a plurality of concave portions 58 along the paper ejection direction PD. The stopper 56 has a protrusion 61 that is engageable with the concave portion 58. The protrusion 61 is coupled to a slide switch 62 via a spring. Causing the slide switch 62 to move in a direction away from the support surface 52 causes the spring to contract, allowing the protrusion 61 to be detached from the concave portion 58. Then, in this state, the stopper 56 can be moved along the guide grooves 57. On the other hand, releasing the slide switch 62 causes the spring to extend, allowing the protrusion 61 to be engaged in a state of being biased toward the concave portion 58. The protrusion 61 is biased in an engagement state with the concave portion 58, to thus restrict the movement of the stopper 56.

Further, the loading apparatus 50 is switched between the first state ST1 where the braking member 54 comes in contact with the cut paper CP, and the second state ST2 where the braking member 54 does not come into contact with the cut paper CP. The first state ST1 and the second state ST2 correspond to FIG. 3 and FIG. 4, respectively. Further, in the embodiment, as illustrated in FIG. 4, the loading apparatus 50 is in the second state ST2 when the stopper 56 is located at the first position PT1, and the loading apparatus 50 is in the first state ST1 when the stopper 56 is located at the second position PT2, as illustrated in FIG. 3.

In the embodiment, there is provided a cover member 70 that is movable to different positions between the first state ST1 and the second state ST2. In the first state ST1, the cover member 70 is located at an open position at which the cut paper CP can come in contact with the braking member 54, while in the second state ST2, the cover member 70 is located at a cover position at which the cover member 70 covers the vertically above the braking member 54. That is, the first state ST1 is a state where the cover member 70 is located at the open position, while the second state ST2 is a state where the cover member 70 is located at the cover position.

In other words, for example, when ejecting the cut paper CP1 having a relatively small, business card size, and when ejecting the cut paper CP2 having an L-size that is larger in size than the cut paper CP1, it is switchable between when the cut paper CP comes in contact with the braking member 54 and when the cut paper CP does not come in contact with the braking member 54.

Specifically, when ejecting the cut paper CP1 having a business card size, the loading apparatus 50 is switched to the second state ST2 where the cut paper CP1 does not come in contact with the braking member 54, while when ejecting the cut paper CP2 having an L-size, the loading apparatus 50 is switched to the first state ST1 where the cut paper CP2 comes in contact with the braking member 54.

The cover member 70 is formed of a thin plate-shaped plastic material that can cover the entirety of the braking member 54. Examples of the plastic material include polyethylene, polypropylene, polyethylene terephthalate, and the like. The cover member 70 moves to the cover position and the open position as the stopper 56 moves to the first position PT1 and the second position PT2. That is, the loading apparatus 50 is switched between the first state ST1 where the stopper 56 is located at the second position PT2 and the second state ST2 where the stopper 56 is located at the first position PT1.

There are provided protrusions 66 protruding toward the braking member 54 at both end portions, in the width direction, on the side of the restricting surface 56*a* of the stopper 56. The leading end portion of the protrusion 66 is coupled to the lower end portion of the cover member 70. Then, when the stopper 56 is caused to move from the second position PT2 to the first position PT1, the cover member 70 is pushed upward toward the braking member 54 along the support surface 52 to cover a region encompassing the vertically above the braking member 54. That is, the cover position is at the first position PT1 of the stopper 56. On the other hand, when the stopper 56 is caused to move from the first position PT1 to the second position PT2, the cover member 70 is pushed downward along the support surface 52 to release the braking member 54 from the covered state of the cover member 70. The open position is at the second position PT2 of the stopper 56. The user can easily switch the loading apparatus 50 to the first state ST1 and the second state ST2 by causing the cover member 70 to move.

Next, an operation of the loading apparatus 50 included in the printer 11 will be described.

FIGS. 5 to 9 are views schematically illustrating the operation of the loading apparatus 50.

Here, in the embodiment, the operation when ejecting each of the cut paper CP1 having a business card size and the cut paper CP2 having an L-size that is larger in size than the cut paper CP1 is described.

Here, depending on the difference in size of the cut papers CP, the tendency of the occurrence of curl differs. Specifically, the cut paper CP2 having the larger size have a tendency to curl larger than the cut paper CP1. For example, the curl is considered to occur when the winding habit of the roll body R is strong. Because the printer 11 of the embodiment performs recording on the sheet S that is wound around the roll body R, the winding habit that occurs when the second surface P2 is at the outer side and the first surface P1 is at the inner side becomes strong depending on the material of the sheet S, which causes the sheet S on which recording has been performed to be ejected through the paper exit 13 and to then be curved (curled) immediately. In this case, the sheet S curls convexly with respect to the support surface 52. The cut paper CP2 having a larger size, due to its greater susceptibility to the winding habit, curls more than the cut paper CP1. On the other hand, the cut paper CP1 hardly curls. Note that the degree of the curl in the embodiment is the difference between the length of the cut paper CP and the distance between the both ends in the length direction of the cut paper CP.

When the curl of the cut paper CP2 is large in the support surface 52, the downstream end portion in the paper ejection direction PD of the cut paper CP2 that is subsequently ejected cannot override the second surface P2 that is the upper surface of the cut paper CP2 previously supported, and moves into a position under the cut paper CP2 previously supported to enter between the cut paper CP2 that is previously placed and the support surface 52. As a result, an issue arises that the recording order by which recording has been performed at the recording unit 30 does not coincide with the loading order by which loading is performed in the loading apparatus 50.

Thus, in the embodiment, the above-described issue is resolved by the braking member 54 and the like.

First, a case when ejecting the cut paper CP2 is described.

Figure 5:
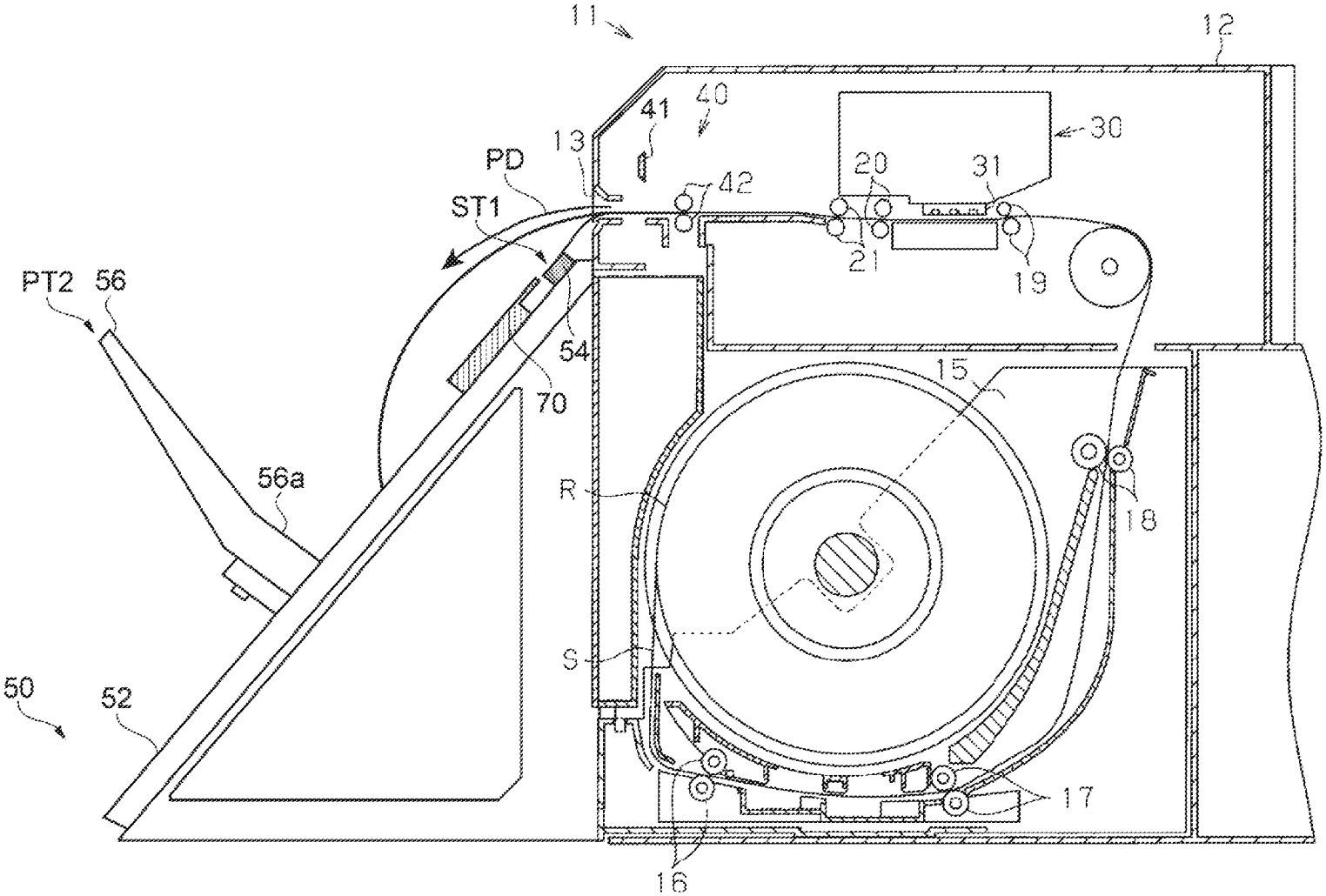
FIG. 5 is a view schematically illustrating an operation of a loading apparatus.
Figure 6:
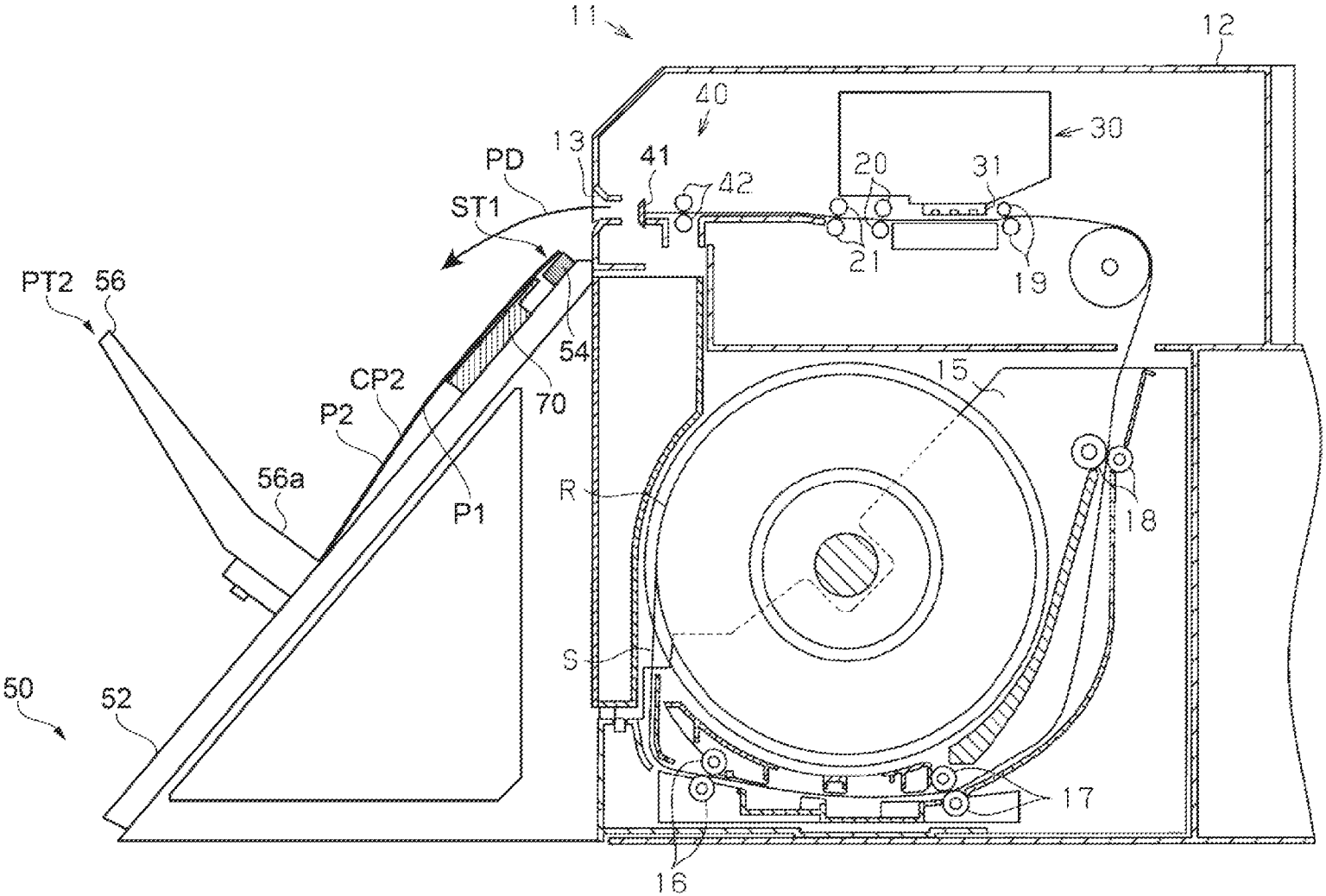
FIG. 6 is a view schematically illustrating an operation of a loading apparatus.
Figure 7:
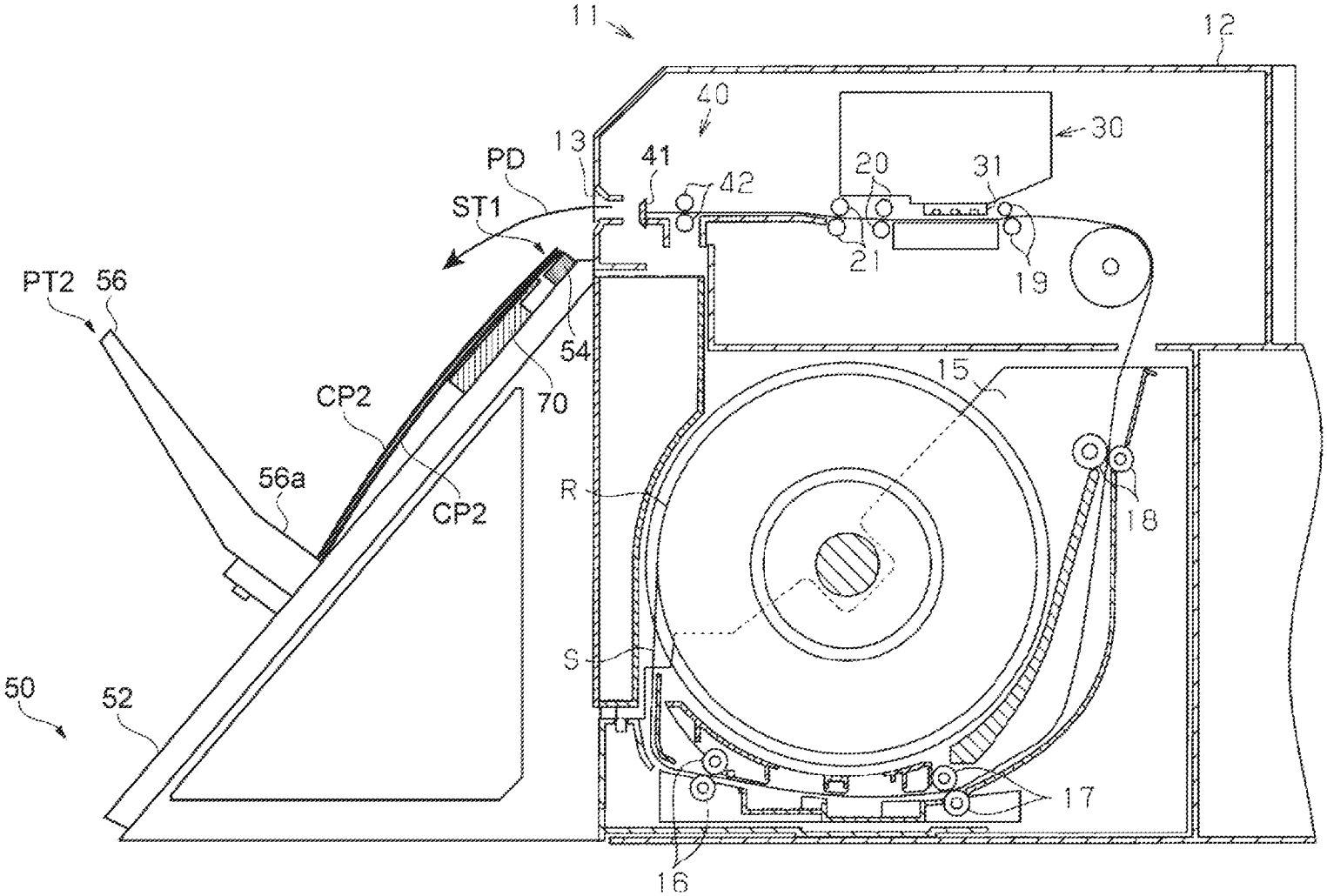
FIG. 7 is a view schematically illustrating an operation of a loading apparatus.

FIGS. 5 to 7 are views schematically illustrating the operation of the loading apparatus 50 when ejecting the cut paper CP2.

When ejecting the cut paper CP2, the stopper 56 is caused to be located at the second position PT2. At this time, the loading apparatus 50 is in the first state ST1, and the braking member 54 is at the open position at which the cover member 70 is uncovered by the braking member 54.

As illustrated in FIG. 2 described above, when performing recording on the sheet S, the transport rollers 16 to 21 are driven to cause the sheet S in a state of being wound around the roll body R to be unwound, as well as to cause the sheet S to be transported toward the paper exit 13. When the sheet S has been transported to the recording unit 30, an ink is injected from the liquid injection head 31 onto the sheet S to perform recording on the sheet S. That is, in a state where recording is being performed on the sheet S, the recording surface of the sheet S faces vertically upward, and the non-recording surface of the sheet S faces vertically downward. In the embodiment, the recording surface corresponds to the second surface P2 of the cut paper CP, and the non-recording surface corresponds to the first surface P1 of the cut paper CP. Note that, depending on the configuration of the recording unit 30, the first surface P1 may be the recording surface and the second surface P2 may be the non-recording surface, and both of the first surface P1 and the second surface P2 may be the recording surfaces.

As illustrated in FIG. 5, when recording is performed on the sheet S, in order to generate the cut paper CP2 by cutting the sheet S on which recording has been performed, the sheet S on which recording has been performed is transported further downstream of the recording unit 30 in the paper ejection direction PD. When the sheet S is ejected through the paper exit 13 to the outside of the printer 11, the sheet S moves downward under its own weight while curling in a state where the downstream end portion of the sheet S is being in contact with the support surface 52.

Next, as illustrated in FIG. 6, the sheet S, which is fixed with the clamping roller pair 42, is cut to generate the cut paper CP2 on which recording has been performed.

The first surface P1 of the upstream end portion in the paper ejection direction PD of the cut paper CP2 that has been cut comes in contact with the braking member 54. The contacting part of the cut paper CP2 that is in contact with the braking member 54 is held by friction with the braking member 54. This allows, in a state where the contacting part of the cut paper CP2 that is in contact with the braking member 54 is being held, the downstream end portion of the cut paper CP2 moves downward of the support surface 52 to come in contact with the restricting surface 56*a* of the stopper 56, and then the cut paper CP2 of the first sheet is supported on the support surface 52. The cut paper CP2 of the first sheet, in a state where the contacting part with the braking member 54 is being held, is stretched by moving under its own weight following the support surface 52. This allows the support surface 52 to support the cut paper CP2 in a state where the curled state is being corrected to be substantially flat.

Next, as illustrated in FIG. 7, the cut paper CP2 of the second sheet on which recording has been performed, when ejected through the paper exit 13, is loaded in a substantially flat state following the second surface P2 of the cut paper CP2 of the first sheet. After that, the cut paper CP2 subsequently processed is loaded in the same manner.

Next, a case when ejecting the cut paper CP1 is described.

Figure 8:
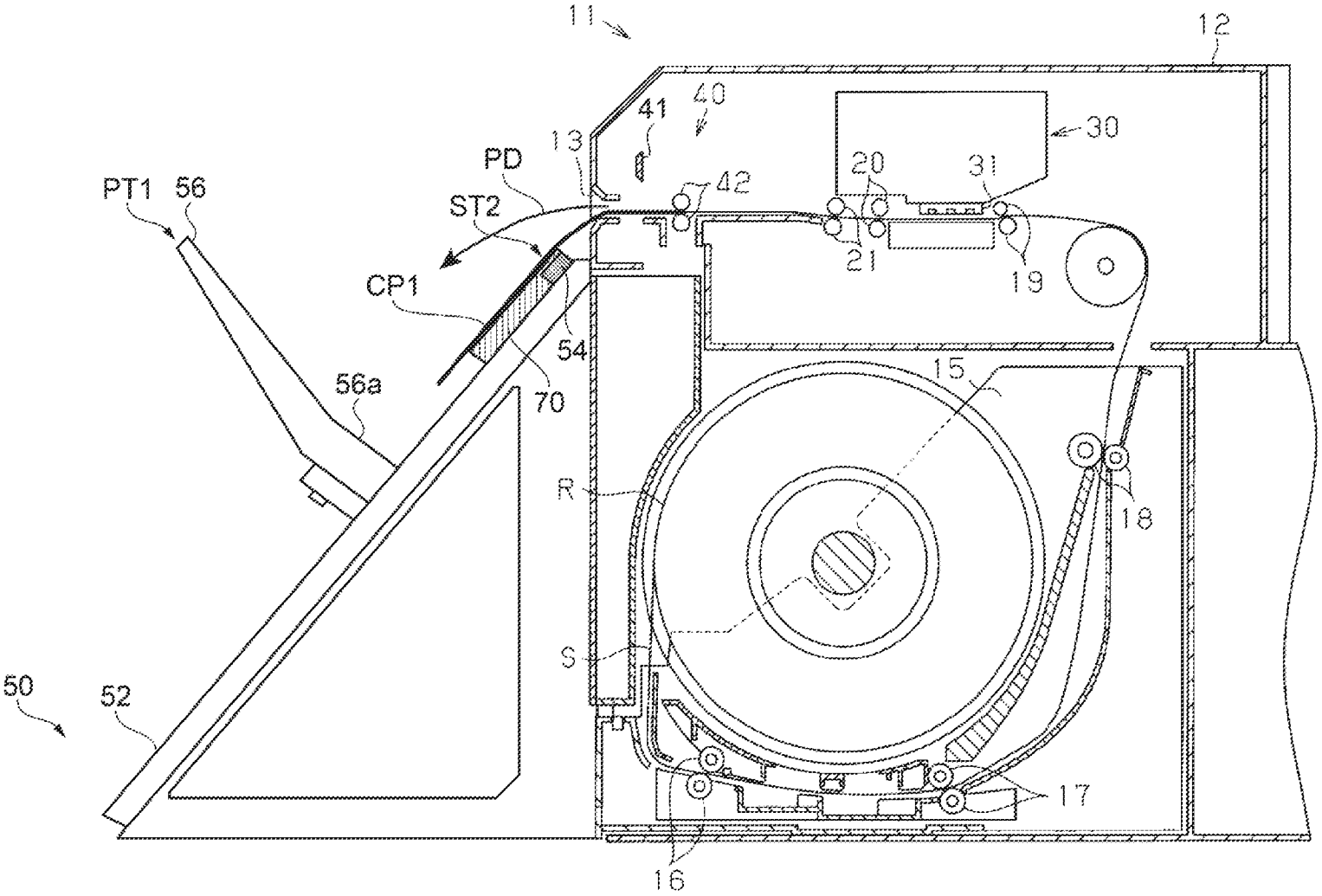
FIG. 8 is a view schematically illustrating an operation of a loading apparatus.
Figure 9:
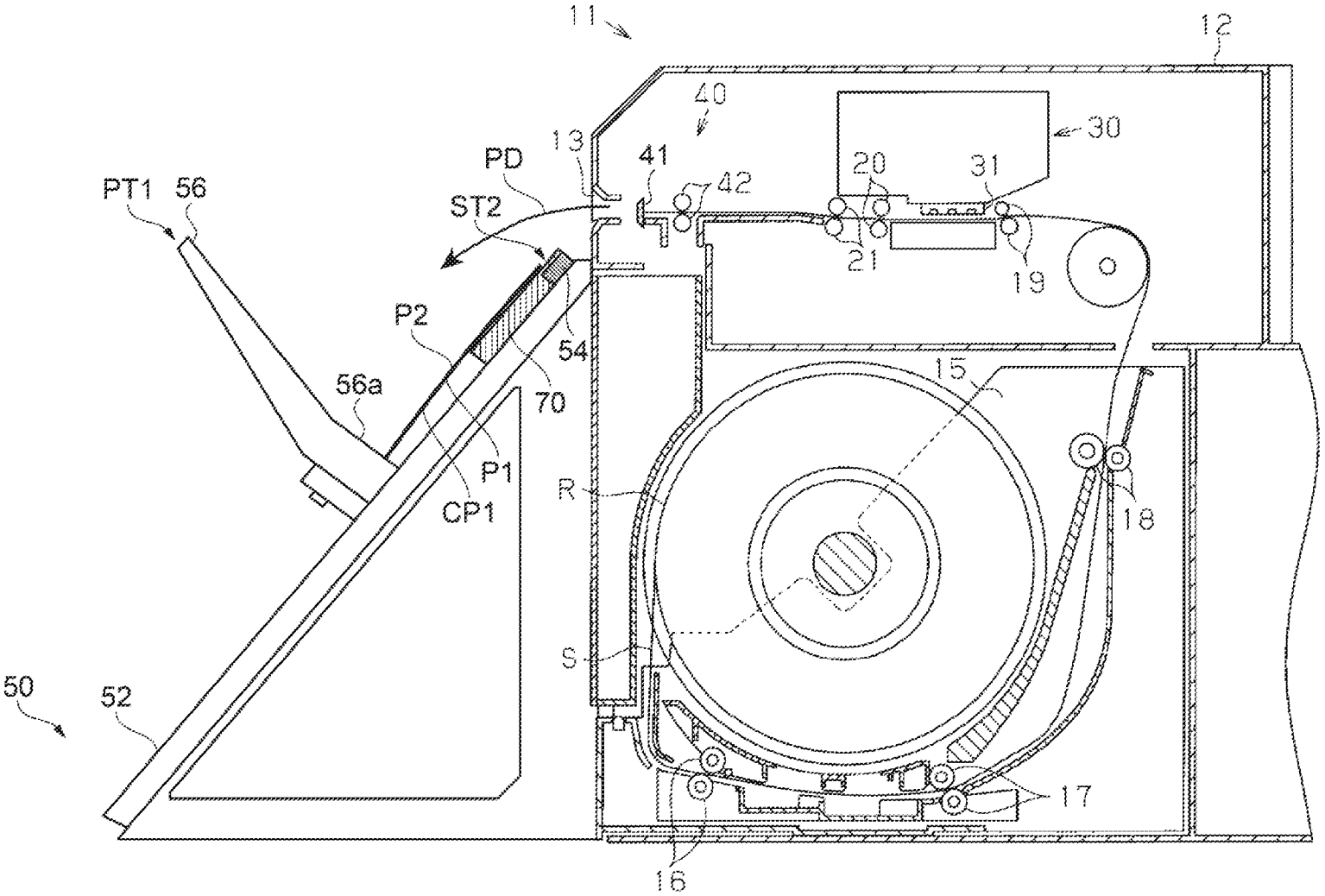
FIG. 9 is a view schematically illustrating an operation of a loading apparatus.

FIGS. 8 and 9 are views schematically illustrating the operation of the loading apparatus 50 when ejecting the cut paper CP1.

When ejecting the cut paper CP1, the stopper 56 is caused to be located at the first position PT1. At this time, the loading apparatus 50 is in the second state ST2, and the braking member 54 is at the cover position at which the braking member 54 is covered by the cover member 70.

As illustrated in FIG. 8, similar to those described above, the transport rollers 16 to 21 are driven to cause the sheet S in a state of being wound around the roll body R to be unwound, as well as to cause the sheet S to be transported toward the paper exit 13. When the sheet S has been transported to the recording unit 30, an ink is injected from the liquid injection head 31 onto the sheet S to perform recording on the sheet S.

When recording is performed on the sheet S, in order to generate the cut paper CP1 by cutting the sheet S on which recording has been performed, the sheet S on which recording has been performed is transported further downstream of the recording unit 30 in the paper ejection direction PD. When the sheet S is ejected through the paper exit 13 to the outside of the printer 11, the sheet S moves downward under its own weight in a state where the downstream end portion of the sheet S is being in contact with the support surface 52.

As illustrated in FIG. 9, the sheet S, which is fixed with the clamping roller pair 42, is cut to generate the cut paper CP1 on which recording has been performed. The first surface P1 of the upstream end portion in the paper ejection direction PD of the cut paper CP1 that has been cut is transported downward along the support surface 52 under its own weight without coming in contact with the braking member 54, to come in contact with the restricting surface 56*a* of the stopper 56*a*, and then the cut paper CP1 of the first sheet is supported on the support surface 52. The cut paper CP1, in which a curl occurs hardly at all due to its relatively small size, is supported by the support surface 52 in a substantially flat state.

Next, the cut paper CP1 of the second sheet on which recording has been performed, when ejected through the paper exit 13, is loaded in a substantially flat state following the second surface P2 of the cut paper CP1 of the first sheet. After that, the cut paper CP1 subsequently processed is loaded in the same manner.

According to the embodiment, the following advantageous effects can be achieved.

When causing the cut paper CP2 to be ejected, the first state ST1 is established where the braking member 54 comes into contact with the cut paper CP2. The cut paper CP2 that is firstly ejected through the paper exit 13 is supported on the support surface 52 in a state where the upstream end portion of the cut paper CP2 is being held by the braking member 54. That is, the cut paper CP2, which is supported in a state of suppressing the occurrence of curl in the cut paper CP2, is supported by the support surface 52 in a substantially flat state. This allows the cut paper CP2 that is subsequently ejected to be loaded in a substantially flat state following on the cut paper CP2 that is firstly supported. Accordingly, the printing order by which the recording unit 30 of the printer 11 performs printing and the printed sheet is ejected through the paper exit 13 can coincide with the loading order by which loading is performed in the loading apparatus 50.

When causing the cut paper CP1 to be ejected, the second state ST2 is established where the braking member 54 does not come into contact with the cut paper CP1. The cut paper CP1 that is firstly ejected through the paper exit 13 is supported on the support surface 52 without coming in contact with the braking member 54. That is, substantially no curl occurs in the cut paper CP1. It is configured such that the cut paper CP1 in which no curl occurs does not intentionally come in contact with the braking member 54. That is, when the cut paper CP1 is brought into contact with the braking member 54, the cut paper CP1 is held by the braking member 54 and may not be transported to the stopper 56. In order to avoid such a failure, the cut paper CP1 is caused to avoid coming in contact with the braking member 54 to suppress variation in the paper ejection orientation of the cut paper CP1, making it possible to perform a stable loading process of the cut paper CP1.

Further, interlocking the first position PT1 and the second position PT2 of the stopper 56 and the first state ST1 and the second state ST2 of the loading apparatus 50 enables to perform appropriate loading process in accordance with the sizes of the cut papers CP1 and CP2.

2. Modification 1

Although in the above-described embodiment, the printer 11 having the configuration is described to which the roll body R around which the sheet S is wound is applied, the present disclosure is not limited to this. For example, the printer may be a printer configured to perform recording on a single sheet of paper. That is, the occurrence factor of the curl in the printed material is not limited to due to the winding habit. This is also applicable to the curl of the printed material due to an application of ink to a single sheet of paper or the like. Specifically, the paper may shrink to cause a curl to occur in the course in which an ink is applied to the paper and then the ink is dried. A configuration that is the same as that described above can be applied to such a printed material.

3. Modification 2

Although the stopper 56 of the above-described embodiment is configured to be movable to a plurality of positions, such as the first position PT1 and the second position PT2, the present disclosure is not limited to this. For example, a configuration may be employed in which the stopper 56 is detachable from the support surface 52, and the user attaches the stopper 56 to any position.

A plurality of the stoppers 56 may also be provided. For example, a stopper 561 for the first position PT1 and a stopper 562 for the second position PT2 are provided. In this case, the stopper 561 for the first position PT1 may be attached to the support surface 52 in a state where the stopper 562 for the second position PT2 is attached to the support surface 52. Further in this case, a configuration may be employed in which the cover member 70 is provided on the stopper 561 for the first position PT1, and the cover member 70 covers the braking member 54 in a state where the stopper 561 for the first position PT1 is attached to the support surface 52.

Moreover, a configuration may be employed in which the stopper 56 of which the installation position is changed depending on the power source. In this case, a configuration may be employed in which the position of the stopper 56 is controlled based on the setting information related to the length in the paper ejection direction of the cut paper CP to be ejected.

4. Modification 3

Although the first state ST1 and the second state ST2 of the loading apparatus 50 are switched by the cover member 70, the present disclosure is not limited thereto. For example, a configuration may be employed in which the braking member 54, by retracting from the support surface 52, causes the first state ST1 and the second state ST2 of the loading apparatus 50 to be switched.

Contents derived from the embodiment will be described below.

A loading apparatus supporting a printed material ejected through a paper exit of a printer body, the loading apparatus including a support surface facing forward and inclined vertically downward from the paper exit and moreover configured to come into contact with a first surface of the printed material, the first surface being a vertically downward surface at the paper exit, a braking member provided near the paper exit and configured to come into contact with the first surface and to hold a part, which contact therewith, of the printed material, and a stopper configured to come into contact with a downstream leading end of the printed material in a paper ejection direction in which the printed material is ejected, wherein the stopper is configured to be located at a first position and a second position on the support surface, and a distance between the second position and the paper exit is greater than a distance between the first position and the paper exit.

According to the above configuration, a part near the paper exit of the printed material, that is, an upstream part in the paper ejection direction of the first surface of the printed material comes in contact with the braking member in the paper ejection direction in which the printed material is ejected through the paper exit. Then, the printed material follows along the support surface under its own weight in a state where the upstream part is being held by the braking member. This reduces the displacement force for causing the printed material to curl convexly with respect to the support surface, suppressing the occurrence of curl in the printed material. Accordingly, the printed material is supported on the support surface in a substantially flat state. This allows the printed material that is subsequently ejected to be loaded in a substantially flat state following on the printed material that is previously placed. Accordingly, the printing order by which the printer performs printing and the printed sheet is ejected through the paper exit can coincide with the loading order by which loading is performed in the loading apparatus.

The loading apparatus may be configured to switch between a first state where the braking member comes into contact with the printed material and a second state where the braking member does not come into contact with the printed material.

According to the above configuration, for example, the printed material having a relatively large size, which easily curls, is caused to come in contact with the braking member to suppress the occurrence of curl and to enhance the loadability. On the other hand, for a printed material in which a curl occurs hardly at all, for example, a printed material having a relatively small size, the printed material may be held by the braking member and may not be transported. Thus, for the printed material having a relatively small size, a stable loading process of the printed material can be performed by causing the printed material to avoid coming in contact with the braking member.

The loading apparatus may be in the second state when the stopper is located at the first position, and may be in the first state when the stopper is located at the second position.

According to the above configuration, interlocking the position of the stopper and the state of the loading apparatus enables to perform appropriate loading process in accordance with the size of the printed material.

The loading apparatus may include a cover member movable between an open position at which the printed material is able to come in contact with the braking member and a cover position at which a vertically upper side of the braking member is covered, in which the first state is a state where the cover member is located at the open position, and the second state is a state where the cover member is located at the cover position.

According to the above configuration, the first state and the second state can be easily established by causing the cover member to move.

The support surface may have a rib formed thereon along the paper ejection direction.

According to the above configuration, the contact area between the printed material and the support surface is reduced, making it possible to transport the printed material smoothly.

In the loading apparatus, the stopper may be slidable on the support surface.

According to the above configuration, the stopper can be easily moved between the first position and the second position.

A printer including a paper exit through which a printed material is ejected, a support surface facing forward and inclined vertically downward from the paper exit and moreover configured to come into contact with a first surface of the printed material, the first surface forming a vertically downward surface at the paper exit, a braking member provided near the paper exit and configured to come into contact with the first surface and to hold a part, which contacts therewith, of the printed material, and a stopper configured to come into contact with a downstream leading end of the printed material in a paper ejection direction in which the printed material is ejected, and the stopper is configured to be located at a first position and a second position, which is larger in distance from the paper exit than the first position, on the support surface.

According to the above configuration, a part near the paper exit of the printed material, that is, an upstream part in the paper ejection direction of the first surface of the printed material comes in contact with the braking member in the paper ejection direction in which the printed material is ejected through the paper exit. Then, the printed material follows along the support surface under its own weight in a state where the upstream part is being held by the braking member. This reduces the displacement force for causing the printed material to curl convexly with respect to the support surface, suppressing the occurrence of curl in the printed material. Accordingly, the printed material is supported on the support surface in a substantially flat state. This allows the printed material that is subsequently ejected to be loaded in a substantially flat state following on the printed material that is previously placed. Accordingly, the printing order by which the printer performs printing and the printed sheet is ejected through the paper exit can coincide with the loading order by which loading is performed in the loading apparatus.

What is claimed is:

1. A loading apparatus supporting a printed material ejected through a paper exit of a printer body, the loading apparatus comprising:

a support surface facing forward and inclined vertically downward from the paper exit and moreover configured to come into contact with a first surface of the printed material, the first surface being a vertically downward surface at the paper exit;

a braking member provided near the paper exit and configured to come into contact with the first surface and to hold a part, which contacts therewith, of the printed material, wherein the braking member is an upper end portion of the support surface; and a stopper configured to come into contact with a downstream leading end of the printed material in a paper ejection direction in which the printed material is ejected, wherein the stopper is locatable at a first position and a second position on the support surface, and a distance between the second position and the paper exit is greater than a distance between the first position and the paper exit.

2. The loading apparatus according to claim 1, wherein the loading apparatus switches between a first state where the braking member comes into contact with the printed material and a second state where the braking member does not come into contact with the printed material.

3. The loading apparatus according to claim 2, wherein the loading apparatus is in the second state when the stopper is located at the first position and is in the first state when the stopper is located at the second position.

4. The loading apparatus according to claim 2, comprising a cover member movable between an open position at which the printed material is able to come in contact with the braking member and a cover position at which a vertically upper side of the braking member is covered, wherein the first state is a state where the cover member is located at the open position, and the second state is a state where the cover member is located at the cover position.

5. The loading apparatus according to claim 1, wherein the support surface has a rib formed thereon along the paper ejection direction.

6. The loading apparatus according to claim 1, wherein the stopper is slidable on the support surface.

7. A printer comprising:

a paper exit through which a printed material is ejected;

a support surface facing forward and inclined vertically downward from the paper exit and moreover configured to come into contact with a first surface of the printed material, the first surface being a vertically downward surface at the paper exit;

a braking member provided near the paper exit and configured to come into contact with the first surface and to hold a part, which contacts therewith, of the printed material, wherein the braking member is an upper end portion of the support surface; and a stopper configured to come into contact with a downstream leading end of the printed material in a paper ejection direction in which the printed material is ejected, wherein the stopper is configured to be located at a first position and a second position on the support surface, and a distance between the second position and the paper exit is greater than a distance between the first position and the paper exit.

8. A printer comprising:

a paper exit through which a printed material is ejected;

a support surface facing forward and inclined vertically downward from the paper exit and moreover configured to come into contact with a first surface of the printed material, the first surface being a vertically downward surface at the paper exit;

a braking member provided near the paper exit and configured to come into contact with the first surface and to hold a part, which contacts therewith, of the printed material; and a stopper configured to come into contact with a downstream leading end of the printed material in a paper ejection direction in which the printed material is ejected, wherein the stopper is configured to be located at a first position and a second position on the support surface, a distance between the second position and the paper exit is greater than a distance between the first position and the paper exit, and the loading apparatus switches between a first state where the braking member comes into contact with the printed material and a second state where the braking member does not come into contact with the printed material, further comprising a cover member movable between an open position at which the printed material is able to come in contact with the braking member and a cover position at which a vertically upper side of the braking member is covered, wherein the first state is a state where the cover member is located at the open position, and the second state is a state where the cover member is located at the cover position.

* * * * *